US005082231A

United States Patent [19]

Knowles

[11] Patent Number: 5,082,231

[45] Date of Patent: Jan. 21, 1992

[54] POST HOLDER AND MARKER THEREFOR

[76] Inventor: John R. Knowles, 346 Hickroy Tree Rd., Plymouth, Wis. 53073

[21] Appl. No.: 643,367

[22] Filed: Jan. 22, 1991

[51] Int. Cl.[5] ..... F16M 13/00

[52] U.S. Cl. ..... 248/545; 52/153; 52/155; 52/298; 173/129; 248/156; 248/530

[58] Field of Search ..... 248/530, 532, 533, 545, 248/156; 52/155, 165, 153, 154, 298; 173/128, 129, 130, 90

[56] References Cited

U.S. PATENT DOCUMENTS

| | | | |
|---|---|---|---|
| 650,446 | 5/1900 | Barr | 248/156 X |
| 1,539,685 | 5/1925 | Michaud | 248/156 X |
| 2,349,110 | 5/1944 | Potstada | 52/165 |
| 3,066,447 | 12/1962 | Reiterer et al. | 52/155 X |
| 3,342,444 | 9/1967 | Nelson | 248/156 X |
| 3,519,234 | 7/1970 | Matson | 248/156 |
| 4,004,383 | 11/1977 | Watanabe | 52/154 |
| 4,231,435 | 11/1980 | Andreasson | 173/128 |
| 4,298,075 | 11/1981 | Sweeney | 173/129 |
| 4,589,500 | 5/1986 | Moraly | 173/90 |
| 4,874,149 | 10/1989 | Miceli | 248/156 X |
| 4,896,651 | 1/1990 | Kott, Jr. | 248/156 X |

FOREIGN PATENT DOCUMENTS

| | | | |
|---|---|---|---|
| 2560268 | 8/1985 | France | 52/154 |

*Primary Examiner*—David L. Talbott
*Attorney, Agent, or Firm*—Francis J. Bouda

[57] ABSTRACT

A post-support for permanent installation at or below ground level includes a post-receiving collar affixed to fins. The fins have collar supporting shoulders against which a post may rest. A driver/cap/marker has a cap and a sleeve and the sleeve length is the same as the collar length so that when the driver/cap/marker is inserted into the collar the lower edge of the sleeve rests on the shoulders and the underside of the cap/marker rests on top of the collar. The driver/cap/marker serves firstly as a tool for inserting the support into the ground, secondly as a cover for an unused support, and thirdly as marking/locating means for an unused collar.

1 Claim, 1 Drawing Sheet

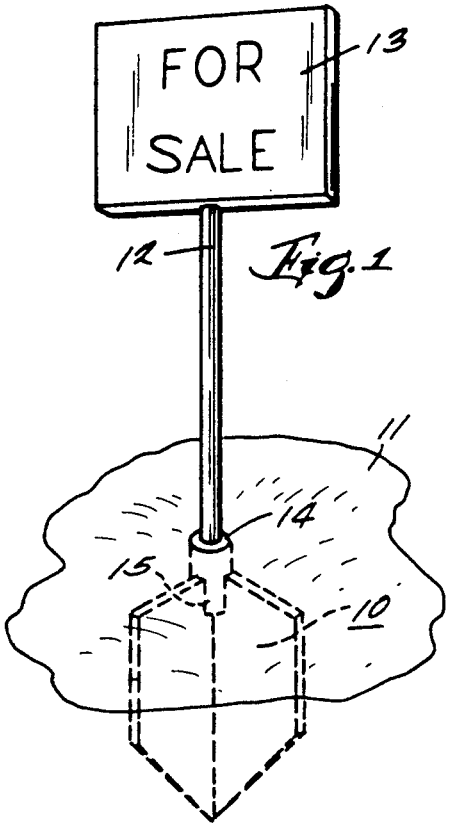
Fig. 1
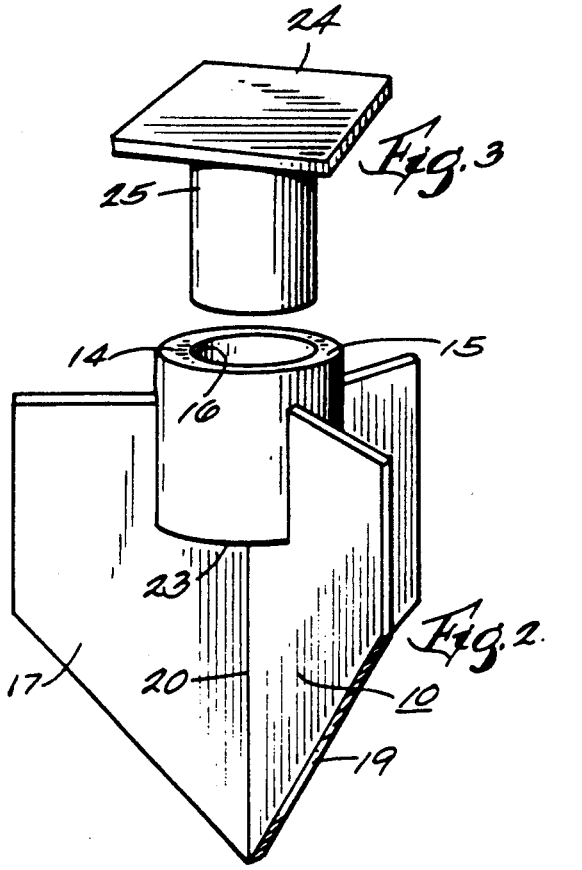
Fig. 3
Fig. 2
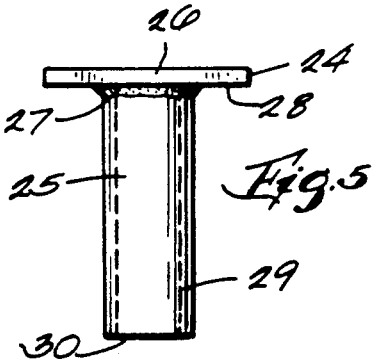
Fig. 5
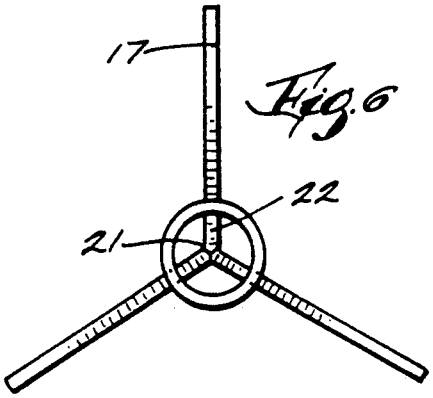
Fig. 6
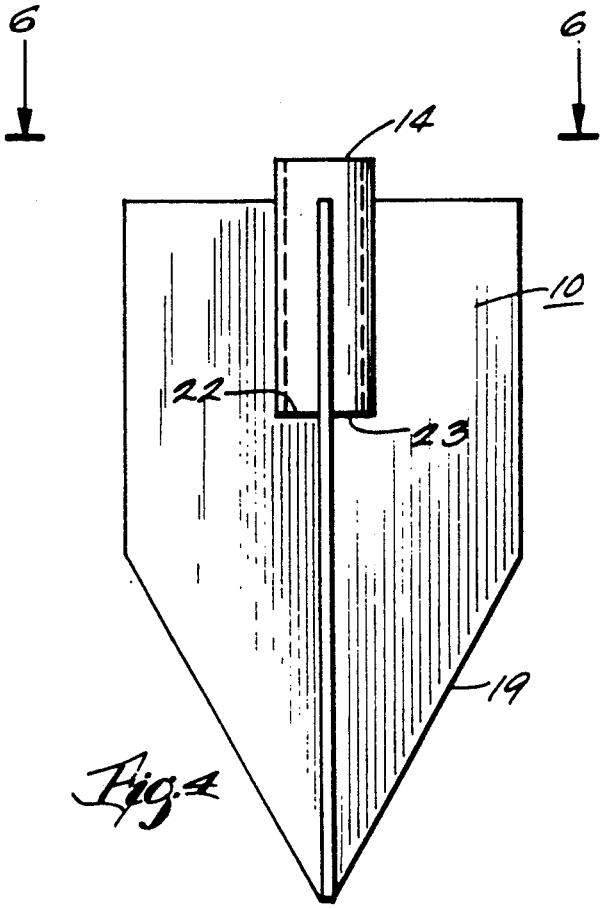
Fig. 4

POST HOLDER AND MARKER THEREFOR

BACKGROUND OF THE INVENTION

It is well-known that in many instances it is desired to have a support for a post or similar matter, particularly the type which can display a temporary sign, and wherein the post can be easily installed and removed, without a lot of labor spent in preparing the earth and the support for the post.

Additionally, it is desirable that such a post support may be maintained permanently in the ground for reapplication of a post thereto, but during the time when a post is not inserted in the post support, the support should be unobtrusive and not provide any dangerous protrusion above ground level against which a person may stumble, or which a mechanical device such as a lawn mower would impinge. It should also be easy to locate.

Although prior art devices have been shown, and I refer particularly to the Miceli U.S. Pat. No. 4,874,149, and the prior art referred to during the prosecution of that patent which issued on Oct. 17, 1989, it is clear that the prior devices have limitations and unwanted features, all of which are eliminated or overcome by the device of the present invention.

The prior art fails to teach how a post support may be inserted into the ground, with its uppermost portion at or below ground level, and with a driving-mechanism which serves both to install the post support, and also to cover and mark the location of the post support during the time when a post is not inserted therein.

There are a wide variety of post-supporting devices available that are primarily designed to permanently support construction-type materials, such as pipes, 4×4 posts, mailboxes, and the like. These items are generally supported perpendicularly to the ground, and consist of a hollow section and a ground-engaging section. Often such post-support devices require special or other tools for installation and require the use of separate supporting pins or other devices, such as flanges, to secure the post.

The most recent post-support is disclosed in the aforementioned U.S. Pat. No. 4,874,149 and requires no special tools. However, the socket-supporting member is always disposed above the ground with a special pinching mechanism for engaging a wooden post. This post-support require a short section of the post to install into the ground, and only provides a permanent hole for a typical 4×4 post. When the post is removed from the post-support, the support would be above ground, and would be dangerous to mechanical devices or against which somebody may trip and fall.

OBJECTS OF THE INVENTION

Therefore, one object of the present invention is to provide an inexpensive, easily installed, post support, which may be repeatedly used without having to be removed from the ground, and which is unobtrusive when a post is not inserted therein but which nevertheless marks the location so as to make it easy to find for the next use.

A further object of the present invention is to provide a post support and a driving mechanism therefor, which enables easy and quick insertion of the post support into the ground without damaging the support in such a way as to prevent the insertion of a post therein.

Another object of the present invention is to provide a post support particularly adapted for receiving metal posts therein, such as the post for athletic devices, such as volleyball nets, basketball backboards, football goal-posts, "for sale" signs, and the like.

Another object of the present invention is to provide an inexpensive, easily fabricated, sturdy, reusable post-support.

SUMMARY OF THE INVENTION

Unlike the post-supports of the prior art, the present invention provides a support that can be used permanently, if desired, or temporarily. The entire supporting housing is completely underground, and is provided with a driver/cap/ marker which is used for inserting the support into the ground, and which also marks the location of the support, when not in use, so it is easy to find for the next use.

The driver/cap/marker also keeps the post-support hole clean when not be used.

Furthermore, the device of the present invention is particularly useful for recreational installations and can be used temporarily and then stored or moved to a different location.

The device may come in several sizes for various application, and eliminates setup time by establishing and marking a defined location, and also eliminates the need for any guide ropes.

Therefore, the primary use and application is as a temporary support and marking for reuse.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIG. 1 is a perspective sketch illustrating one use of the post-support of the present invention.

FIG. 2 is a perspective view of the post-support illustrating particularly the ground-engaging fins and the post-supporting collar.

FIG. 3 represents the driver/cap/marker used to insert the support into the ground and to cover and mark the hole when not in use.

FIG. 4 is a vertical side elevational view of the support shown in FIG. 2.

FIG. 5 is a side elevational view of the driver/cap/marker shown in FIG. 3.

FIG. 6 is a top plan view taken generally along lines 6—6 of FIG. 4.

Referring now to FIG. 1, there is illustrated the post-support 10 of the present invention as it is disposed beneath ground level 11 to support a post 12 carrying a sign or other indicia 13.

The post-support 10 is generally inserted into the ground 11 with the upper edge 14 of the collar 15 flush with the ground level 11.

As can be seen more clearly in FIGS. 2-6, the post-support 10 includes a collar or ring 15, having an internal diameter 16 suitable to receive the external diameter of the post 12.

The vertical length of the collar 15 is selectively chosen so as to support, without substantial wiggling, the post 12 and sign 13.

To the outer surface of the collar 15 there are welded or otherwise permanently secured a plurality of fins 17, which extend laterally to the edges 18 beyond and away from the external diameter of the collar 15.

Each of the fins 17 has a tapered edge 19, a central edge 20. The central edges 20 of each of the three fins are joined together as by welding centrally and below the middle of the collar 15, as is shown particularly at 21 in FIG. 6.

Each of the fins 17 also has an off-set shoulder 22 which lies beneath the lower edge 23 of the collar 15.

Thus the three fins 17 and the collar 15 provide a Y-shaped wedge which can be driven into the ground, carrying the collar 15 therewith until the upper edge 14 is disposed at a level with the surface of the ground 11.

There is also provided a driver/cap/marker 24 which includes a tubular member or sleeve 25 and a flat cap/-marker 26, both of which items are securely fastened together as by welding or otherwise where the upper edge 27 of the sleeve 25 meets the underside 28 of the cap/marker 26.

The outer diameter 29 of the sleeve 25 is dimensioned so as to fit easily but firmly within the inner-diameter 16 of the collar 15. The length of the tubular portion or sleeve 25 is chosen so that the lower edge 30 rests upon the shoulders 22 of the fins 17 when the underside 28 of the cap/ marker 26 rests upon the upper edge 14 of the collar 15.

Thus when it is desired to insert the post-support into the ground the driver/cap/marker 24 is driven into the ground at the desired location. The driver/cap/marker 24 is then removed from the earth, removing a "plug" of earth with it. The "plug" of earth is then removed from the driver/cap/ marker and the post-support 10 is placed over the hole and the driver/cap/marker 24 is then inserted into the collar 15.

Then the upper surface of the driver/cap/marker 24 can be struck with a mallet or other driving device, forcing the support 10 into the ground.

The dimensions of the driver/cap/marker and the collar 15 are important because the driver/cap/marker may, if desired, bear against both the upper edge 14 of the collar 15, as well as the shoulders 22 of the fins 17.

This insures that the driving forces (when the driver/cap/marker 24 is struck by a mallet or the like) are distributed equally against the fins 17 and the collar 15, thus to avoid any distortion or disfiguring of the collar 15. If desired the sleeve 25 may be slightly longer than the collar 15 so that the striking force is only against the edges 22 of the fins 17.

Because the support is easily driven into the ground to the point where the upper surface of the cap 26 is at ground level, the driver/cap/marker can then be removed and the post 12 inserted into the collar 15.

When the utility of the sign 13 is no longer needed, the post 12 and sign 13 can be removed, and the driver/-cap/marker replaced into the collar 15, and the entire assembly is then flush with the ground level so as to avoid any protrusion which would cause somebody to stumble and fall or, moreover, across which any utilitarian device, such as a lawn mower, may move without striking the post-support.

Because the driver/cap/marker 24 marks the location of the hole, later on, when the post-support 10 is to be reused, the driver/cap/marker 24 can easily be located, removed from the post-support 10, and the post 13 reinserted or another different post and sign 13 may be placed therein. As can be seen and is evident, such re-use of a post-support is particularly advantageous in badminton courts, volleyball courts, football and soccer fields, tether ball, driving golf nets, horseshoe courts, temporary "for sale" signs, support for flowers, birdhouses, torches, flag poles, clothesline poles, fences, markers, bird feeders, Christmas decorations, baseball backstops, illumination, outdoor lighting, animal fencing or containment, landscaping, temporary displays, camping, gardens, rain gauges and the like.

Although the post-support shown in the drawings and as described is generally related to a round configuration of the collar 15 (and the diameter may be preferably somewhere between ½" to 6"), it is to be understood that the collar may be of other geometric configuration.

The post-support of the present invention preferably is made of steel; however, aluminum, aluminum casting, stainless, and other metals can be employed but may not be as cost-effective.

The principal purpose is to provide an economical, safe, permanently-installed, marked location for temporary poles or posts.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. A post-support for permanent installation at or below ground level for temporarily supporting a removable post in a generally upright vertical position, said post-support including:

a post-receiving collar, a ground-engaging member secured to said collar, and a driver/cap/marker removably engaged in said collar, said ground-engaging member including at least two fins having tapered edges terminating in a mutual point and rigidly secured to said collar, each fin having a lateral collar-supporting edge disposed beneath the bottom edge of said collar, said driver-cap/marker including a sleeve adapted to fit within said collar, and also including a flat cap suitable for a driving surface, said sleeve adapted to be driven into the ground so as to cut a plug of ground which can be removed by and with the sleeve when the sleeve is withdrawn from the ground, said sleeve having a vertical length substantially the same as the length of said collar so that the underside of said flat cap touches the top edge of the collar when the sleeve is disposed within the collar and the lower end of the sleeve engages the collar-supporting edges of fins.

* * * * *